US008525106B2

(12) United States Patent
Muntean

(10) Patent No.: US 8,525,106 B2
(45) Date of Patent: Sep. 3, 2013

(54) METHOD AND APPARATUS FOR TRANSMITTING IONS IN A MASS SPECTROMETER MAINTAINED IN A SUB-ATMOSPHERIC PRESSURE REGIME

(75) Inventor: Felician Muntean, Danville, CA (US)

(73) Assignee: Bruker Daltonics, Inc., Billerica, MA (US)

( * ) Notice: Subject to any disclaimer, the term of this patent is extended or adjusted under 35 U.S.C. 154(b) by 121 days.

(21) Appl. No.: 13/103,415

(22) Filed: May 9, 2011

(65) Prior Publication Data

US 2012/0286150 A1 Nov. 15, 2012

(51) Int. Cl.
*H01J 49/10* (2006.01)
*H01J 49/42* (2006.01)

(52) U.S. Cl.
USPC ..... 250/282; 250/281; 250/290

(58) Field of Classification Search
USPC ..... 250/281–282
See application file for complete search history.

(56) References Cited

U.S. PATENT DOCUMENTS

| | | | | |
|---|---|---|---|---|
| 4,963,736 | A * | 10/1990 | Douglas et al. | 250/292 |
| 5,412,207 | A * | 5/1995 | Micco et al. | 250/288 |
| 6,331,702 | B1 * | 12/2001 | Krutchinsky et al. | 250/281 |
| 6,392,225 | B1 * | 5/2002 | Schwartz et al. | 250/292 |
| 6,575,897 | B1 | 6/2003 | Ory et al. | |
| 7,385,185 | B2 * | 6/2008 | Dowell et al. | 250/281 |
| 2002/0100870 | A1 | 8/2002 | Whitehouse et al. | |
| 2003/0042412 | A1 | 3/2003 | Park | |
| 2003/0080290 | A1 | 5/2003 | Baranov et al. | |
| 2003/0189171 | A1 * | 10/2003 | Londry et al. | 250/292 |
| 2004/0026614 | A1 * | 2/2004 | Bateman et al. | 250/281 |
| 2004/0238755 | A1 * | 12/2004 | Lee et al. | 250/423 R |
| 2005/0151074 | A1 * | 7/2005 | Thakur | 250/288 |
| 2006/0113464 | A1 * | 6/2006 | Litherland et al. | 250/288 |
| 2007/0045530 | A1 * | 3/2007 | Miller et al. | 250/282 |
| 2008/0210860 | A1 | 9/2008 | Kovtoun | |
| 2009/0045334 | A1 | 2/2009 | Ding | |
| 2009/0134322 | A1 * | 5/2009 | Thomson | 250/282 |
| 2009/0261248 | A1 * | 10/2009 | Glavish et al. | 250/298 |
| 2009/0302210 | A1 * | 12/2009 | Castro-Perez et al. | 250/282 |
| 2010/0301227 | A1 | 12/2010 | Muntean | |

FOREIGN PATENT DOCUMENTS

GB 2474172 A 4/2011

* cited by examiner

*Primary Examiner* — Robert Kim
*Assistant Examiner* — David E Smith
(74) *Attorney, Agent, or Firm* — Robic, LLP

(57) ABSTRACT

A method and apparatus for transmitting ions in a mass spectrometer from an ion source to a mass analyzer extracts analyte ions from the ion source in such a manner that the number of extracted analyte ions is maximized. The ions are then transmitted through an ion guide to the mass analyzer. The ion guide is filled with an interaction gas and its operating parameters are adjusted so that, as the ions pass through the ion guide, the analyte ion energy distribution width is narrowed and the analyte ions are collimated within the ion guide to improve the resolution and sensitivity of the mass analyzer.

32 Claims, 6 Drawing Sheets

METHOD AND APPARATUS FOR TRANSMITTING IONS IN A MASS SPECTROMETER MAINTAINED IN A SUB-ATMOSPHERIC PRESSURE REGIME

BACKGROUND

The invention relates to a method of transmitting ions in a mass spectrometer maintained in a sub-atmospheric pressure regime. The invention also relates to a mass spectrometer, preferably coupled to a gas chromatograph. Mass spectrometers coupled with gas chromatographs (GC-MS) usually employ vacuum ion sources, that is, ion sources maintained at a substantially sub-atmospheric pressure level. One standard form of ionization in GC-MS systems is electron ionization (EI). Therein, the analyte molecules being entrained in a continuous gas-flow of the gas chromatograph enter the source region of the mass spectrometer. They are irradiated with free electrons usually emitted from a filament. By this exposure, besides of being ionized, the analyte molecules are also fragmented in a characteristic manner. EI is a "hard ionization" technique and results in the creation of many fragments of low mass to charge ratio m/z and only a few, if any, molecular ions. The molecular fragmentation pattern depends on the energy imparted to the electrons, typically on the order of 70 electron volts (eV).

Ion sources employed in GC-MS can alternatively apply chemical ionization (CI). In chemical ionization a reagent gas, typically methane or ammonia, is introduced in excess into the source region of the mass spectrometer and ionized by bombardment with high energetic free electrons. The resultant primary reagent ions then react further with remaining molecules in collisions to become stable secondary ions. These secondary ions then cause ionization of the analyte molecules of interest. The process may involve transfer of electrons, protons or other charged species between the reagents. In general, CI as a "soft ionization" technique dissociates the analyte molecules to a lower degree than the hard ionization of EI. Chemical ionization, therefore, is mainly employed when mass fragments closely corresponding to the molecular weight of the analyte molecules of interest are desired.

The analyte ions generated in the ion source volume are accelerated and transmitted on an ion path leading from the ion source to a mass analyzer by application of extraction voltages to ion optical lenses, located for example at the ion exit of the ion source. However, since analyte ions generated in different sub-volumes of the ion source volume traverse different acceleration distances before passing the ion exit, and also the potential gradients created by the extraction voltages within the ion source volume are generally spatially inhomogeneous, the kinetic energy distribution (the kinetic energy is linked to the velocity by $E_{kin}=\frac{1}{2}*m*v^2$) of the analyte ions, in particular in the direction of the ion path, is usually relatively wide, for example of the order of one to five electron volts (at full width at half maximum, FWHM). For the sake of conciseness, in the following, the direction of the ion path, along which the analyte ions propagate, is frequently referred to as the axial direction, while summarizing the directions perpendicular thereto as the radial direction.

The wide energy distribution complicates extraction and transmission of analyte ions from the ion source to the mass analyzer, especially when intending to maximize the number of extracted ions using large extraction fields or large extraction apertures. Most mass analyzers used in conjunction with EI or CI ion sources, and quadrupole mass analyzers in particular, show best performance when the initial ion energy distribution and, moreover, the spatial spread of the ions is low. In order to reduce the width of the energy distribution, the ion exit could be configured as an aperture having a limited passable diameter, so that just analyte ions generated in a limited number of sub-volumes of the ion source volume are transmitted to the mass analyzer and analyte ions from the remaining sub-volumes are masked out. This gain in narrow energy distribution width, however, entails a loss of sensitivity as many analyte ions present in the ion source volume and potentially available for the mass analysis are removed and thus not considered in the analysis process.

On the other hand, increasing the number of extracted ions effects a wider initial energy distribution, in particular in the axial direction, and a wider spatial spread so that the mass resolution and/or the transmission efficiency degrade. Therefore, the efficiency of most prior art GC-MS instruments is limited either because they are operated with less than optimal ion extraction from the source in order to minimize the initial ion energy spread or, if the number of extracted ions is increased, the performance of the mass analyzer in terms of resolution and sensitivity suffers.

In the past, there have been attempts for different reasons to condition ion beams by colliding the ions with neutral gas molecules. Such collisional conditioning has been suggested in different mass spectrometric applications, for example, by Douglas et al. (U.S. Pat. No. 4,963,736 A) for focusing of ions generated in an atmospheric pressure electrospray ion source, by Whitehouse et al. (U.S. 2002/0100870 A1) in the pulsing region of an orthogonal time-of-flight mass spectrometer, by Park (U.S. 2003/0042412 A1) in a surface induced dissociation technique for a time-of-flight instrument, or by Baranov et al. (U.S. 2003/0080290 A1) for de-exciting internally excited and hence potentially metastable ions generated in a matrix-assisted laser desorption/ionization ion source. None of these disclosures, however, provide a way of extending the efficiency of an EI or CI source by first performing efficient ion extraction and creating an ion beam of wide energy and spatial spread and then further remediating beam quality through collisional conditioning in an ion guide.

Thus, the need arises to optimize or maximize the transmission efficiency of the ions through the mass analyzer, while also optimizing or maximizing the number of ions extracted from the ion source.

SUMMARY

The invention pertains to a method of transmitting ions in a mass spectrometer maintained in a sub-atmospheric pressure regime. Analyte ions are generated in a conventional manner by an ion source via electron impact or chemical interaction and extraction voltages are applied for transmitting the analyte ions through an ion exit at the ion source in an ion beam to an ion path leading to a mass analyzer. In accordance with the principles of the invention, the extraction voltages or a geometrical dimension of the ion exit, or a combination thereof, are configured such that a (wide) distribution of analyte ion energy results. Subsequently, the extracted analyte ions are transmitted to an ion guide located on the ion path upstream of the mass analyzer. The ion guide is supplied with an interaction gas for a physical or chemical interaction with the analyte ions. At least one of an inner width of the ion guide for passing through the analyte ions, operating voltages applied to the ion guide, a pre-determined length of the ion guide along the ion path, and a pressure regime of the interaction gas in the ion guide are configured such that the distribution of analyte ion energy is narrowed and the analyte ion beam is substantially collimated along the ion path within the ion guide.

Locating an ion guide, preferably immediately, downstream of the ion source on the ion path and supplying the ion guide with an interaction gas, so that the analyte ions being extracted from the ion source are subjected to gentle collisions with the particles of the interaction gas, allows for the width of the analyte ion energy distribution to be reduced while the analyte ions traverse the ion guide. The width of the energy distribution may refer to the full width at half maximum. However, also other width measures are conceivable. The overall efficiency of EI or CI sources is significantly extended by first performing efficient ion extraction and creating an ion beam of wide energy and spatial spread and then further remediating beam quality through collisional interaction with neutrals in an ion guide.

A particularly favorable embodiment of the method includes choosing the aforementioned configurable parameters such that the axial analyte ion energy distribution is narrowed. For this purpose, the axial analyte ion energy can essentially be thermalized in the ion guide (that is, shifted to almost zero axial energy with a small offset caused by an inevitable thermal energy content and avoiding a back motion of the ions). In this manner, the axial motion history of the analyte ions is deleted bringing about a basic motion state from which a further, controlled, motion of the analyte ions may be started. In this case, a driving force can be exerted on the thermalized analyte ions for further driving them forward, especially over the remaining distance up to the output interface between the ion guide and its surroundings, and transmitting them on to the mass analyzer located, preferably immediately, downstream of the ion guide.

In particular embodiments, the driving force exerted on the thermalized analyte ions can be brought about by a direct current (DC) electric field gradient established along the ion path in the ion guide, by a Coulomb repulsion from analyte ions subsequently entering the ion guide, by a tailwind effected through the interaction gas from a point along the ion path where the interaction gas is supplied to the ion guide, or any combination thereof.

The magnitude of the DC electric field can decrease from the one end where ions enter the ion guide to the other end where the ions exit the ion guide, as described in patent application U.S. 2010/0301227 A1 (F. Muntean) the content of which is herewith incorporated by reference in its entirety. In a quadrupole design, the DC electric field gradient may be realized, for instance, by dividing a certain number of the pole electrodes into segments, which are then supplied with different DC voltages as to create a field gradient along the ion guide axis. In a stacked ring electrode design of the ion guide, in another example, the gradient can be realized easily by supplying the ring electrodes arranged serially along the ion path with DC voltages having rising or falling magnitude depending on the polarity of the analyte ions to be investigated.

For pressure de-coupling and thermal de-coupling it may be advantageous to locate the ion source in a first vacuum stage and the ion guide as well as the mass analyzer in a second separate vacuum stage. The pressure regimes established in these vacuum stages can be set such that the pressure in the first vacuum stage is generally larger than the pressure in the second vacuum stage. Thereby, an additional driving force using the principle of gas expansion can promote ion propagation from the ion exit at the ion source along the ion path.

In various embodiments, the ion source may be maintained in a first pressure regime between about $10^{-4}$ and 1 Pascal. The analyte ions are preferably generated from analyte molecules entrained in a gas flow, which can be supplied to the ion source from a gas chromatograph.

In further embodiments, the ion extraction voltages may amount to between about 0 and 500 volts. The ion exit preferably has a cross section area, through which the analyte ions pass, of between 0.25 and 400 $mm^2$. The term extraction voltages is to be understood in a broad sense, such as a means for driving ions from one location to another and may, for example, include push voltages supplied to an ion repeller plate situated in the ionization area. The ion push (repeller) voltages applied in operation of the ion source may amount to between about 0 and 500 volts. A tube or aperture lens, being supplied with pull voltages in another embodiment, can be situated at the ion exit of the ion source. The geometrical dimension of the ion exit preferably includes the aperture diameter, the inner tube radius and/or a contour of the tube rim.

The interaction gas may be a collision gas for essentially non-fragmenting collisions with the analyte ions. Preferably, it is a light gas in order to provide small energy loss per collision and avoid fragmentation. The extent of fragmentation of the analyte ions in the ion guide is preferably kept below ten percent. Helium or any other suitable light gas of low reactivity is suitable for this purpose.

Additionally or alternatively, the interaction gas can be a chemically reactive gas for a chemical modification of the analyte ions, such as methane, ammonia or a combination thereof. By means of a chemical modification, identification of unknown ionized molecules may be improved. As the case may be, chemical modification might prove useful for identifying and eliminating matrix interferences.

In various embodiments, the ion guide can generally be a multipole ion guide, such as a quadrupole ion guide, being supplied with radio frequency (RF) voltages for generating pseudopotentials as is known in the art. In doing so, radial focusing of the ions within the ion guide, independent of ion polarity, can be achieved. Quadrupole radial focusing fields are preferred since they feature the strongest focusing of all multipoles and may help to accelerate ions, which have been collisionally thermalized, by Coulomb repulsion (that is, a kind of "space-charge push"). This Coulomb repulsion, as the case may be, can be a result of continuously incoming ions of same polarity.

In further embodiments, the gas inlet may be located in a center region of the ion guide along the ion path. However, other locations are also conceivable. The pressure of the interaction gas in the ion guide preferably peaks at a position of an inlet through which the interaction gas is supplied. The peak pressure level can amount to, for example, between about $10^{-1}$ and 10 Pascal. The pressure profile may be trapezoidal. The pressure then decreases slowly inside the ion guide from the center to the ends. Finally, it decreases abruptly outside the ion guide to the background pressure in the second vacuum stage.

In some embodiments, the ion guide may be curved having an angle of curvature, for example, of between about 30° and 180°. With a curved design the input axis of the ion guide does not coincide with the output axis so that ions passing it are deflected by the radially focusing fields of the ion guide. Thus, it may provide a line-of-sight isolation of the neutral and metastable molecular species generated in the ion source from the mass analyzer. Thereby, mass-independent background in the mass spectra can be eliminated or, at least, reduced significantly.

In a particular embodiment, the ion guide has a tube design, such as that for a fragmentation cell disclosed in U.S. Pat. No. 6,576,897, U. Steiner et al., the content of which is herewith incorporated by reference in its entirety. Such a design is generally characterized by an input region facing the ion source where the analyte ions exiting the ion source enter the ion guide, an output region facing the mass analyzer where the analyte ions exit the ion guide, and the inlet through which the interaction gas is introduced but ions do not pass under normal operating conditions. Preferably, the "tube" is closed meaning that the section extending between the input region and the output region is sealed off from the surroundings. In such a closed tube design, there may be merely two openings through which ions can travel, and three openings through which the interaction gas can flow. A closed tube design is advantageous as it facilitates an interaction gas control quite independent from the evacuation conditions in the environment of the ion guide (in the second vacuum stage).

In various embodiments, the pole electrodes of the ion guide may be elongate, and generally extend parallel to the ion path. The cross section of the pole electrodes of the ion guide may have any suitable shape. It can be circular or square, and in certain embodiments, at least for the section facing the inner width of the ion guide, hyperbolic. The inner width of the ion guide, shaped by surfaces of the pole electrodes, may have a square cross section. In certain embodiments, the inner width of the ion guide is smaller than an inner width of the mass analyzer so that ion transmission from the ion guide to the mass analyzer may proceed without geometrical losses. As before, the ion guide and the mass analyzer can be located together in a second pressure regime generally between about $10^{-5}$ and $10^{-1}$ Pascal.

Preferably, the mass analyzer may comprise, sequentially downstream of the ion guide on the ion path, a primary mass filter for selecting parent ions, a fragmentation cell for collision induced dissociation of the selected parent ions, and a secondary mass filter for selecting and/or scanning the resultant daughter ions of interest. In this embodiment, the mass analyzer can be also supplied with a fragmentation gas, such as argon, which is different from the interaction gas supplied to the ion guide, in particular in terms of pressure and molecular weight. In some embodiments, a short RF-only pre-filter can be located immediately upstream of the primary mass filter.

In various embodiments, the operating voltages applied to the ion guide may comprise periodically changing voltages with frequencies of between about 0.2 and 20 megahertz and amplitudes of between about 0 and 10 kilovolts peak-to-peak. The peak pressure level preferably is about between $10^{-1}$ and 10 Pascal. The length of the ion path within the ion guide can be between about 5 and 35 centimeters.

In further embodiments, the ion guide at its ends may have an aperture-free design in order to maximize ion transmission in and out. In this case, the gas containment may be achieved as described in the aforementioned patent U.S. Pat. No. 6,576,897 in conjunction with a fragmentation cell.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 1:
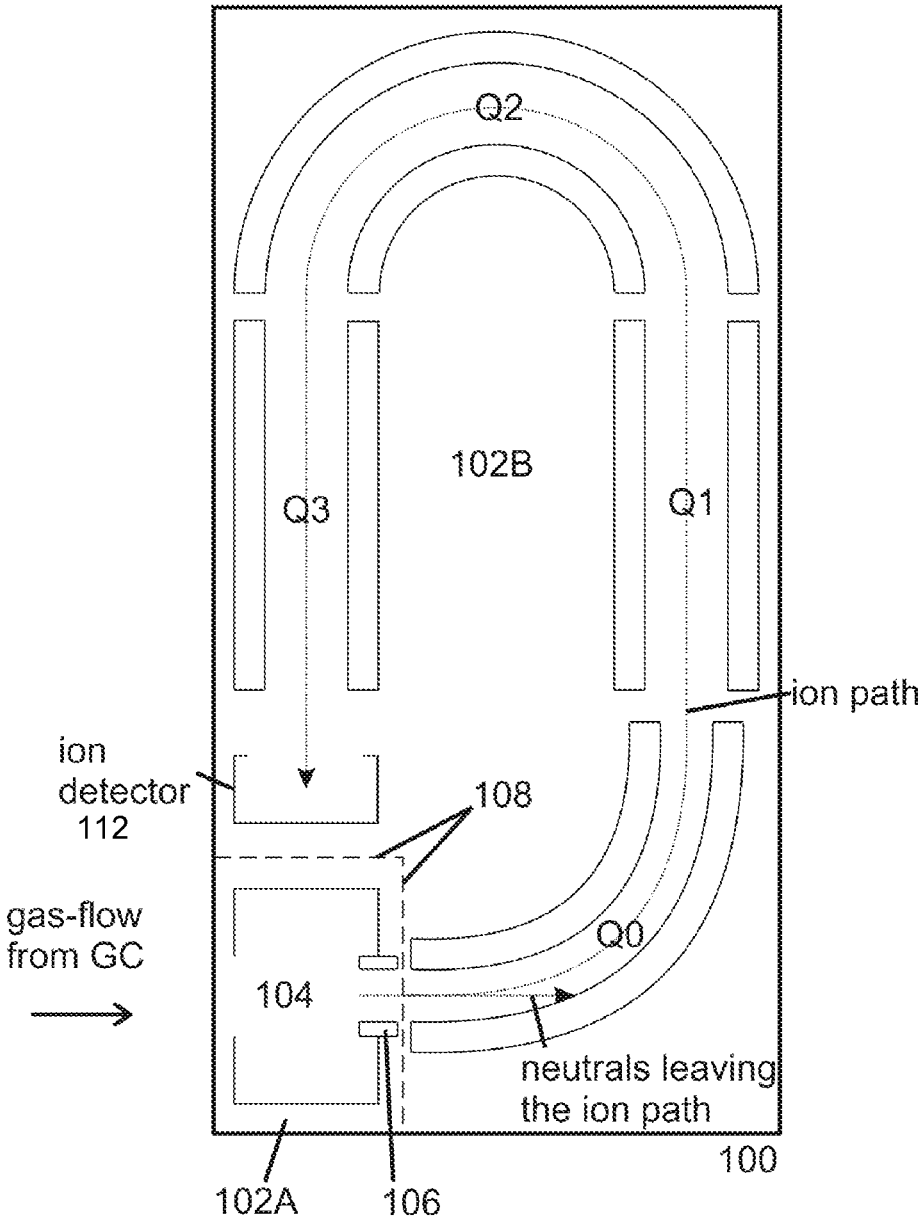
FIG. 1 shows a top view of an embodiment of the apparatus according to the invention.

FIG. 1 is a plan schematic of a mass spectrometer including a quadrupole ion guide Q0 for interacting the ions prior to a triple quadrupole mass analyzer assembly Q1, Q2, Q3 in accordance with an embodiment of the invention. The mass spectrometer is mounted in a housing 100, which is divided in two separate vacuum stages 102A, 102B, and comprises an EI or CI ion source 104, a lens tube 106 at the exit of the ion source 104 for extracting ions and transmitting them to the quadrupole ion guide Q0 for gas-phase interaction, a primary mass filter Q1, a curved quadrupole fragmentation cell Q2 providing a U-turn of the ion path, and a secondary mass filter Q3 in serial alignment between the ion source 104 and an ion detector 112.

Ion source 104 and ion detector 112 are provided at opposing ends of the ion path in the mass spectrometer. Due to the particular path settings in the embodiment shown, the ion source 104 and the ion detector 112 are located immediately adjacent to one other, separated only by intermediate walls 108 (dashed lines) bordering the two vacuum stages 102A, 102B. An ultra-high (turbo) vacuum pump, not shown, may be disposed in the housing 100 to maintain the two vacuum stages 102A, 102B evacuated. Evacuation holes, not shown in FIG. 1, may be provided at different positions of the housing 100. Lens tube 106 and ion source 104 are positioned in a first sealed region of the housing 100 provided by the walls 108 and a sealing ring which engages a cover, both not shown, to provide the vacuum seal.

In this embodiment, at the center of the ion path along the quadrupole ion guide Q0 a gas inlet 110 (FIG. 2) is provided for introducing an interaction gas into the quadrupole ion guide Q0. The inlet 110 may be provided with sealing means such as o-rings, not shown, for ensuring that no interaction gas leaks into the vacuum region of the second vacuum stage 102B thereby increasing the gas load for the pumps.

The quadrupole ion guide Q0 may be configured in analogy to the fragmentation cell for collision induced dissociation described in aforementioned U.S. Pat. No. 6,576,897. In line with this particular example, the ion guide Q0 may be mounted on support plates made of electrically isolating material, polycarbonate, for example. The pole electrodes, in turn, may be mounted on the support plates by means of mounting screws. The pole electrodes can be made of gold plated aluminum. Opposing pole electrodes can be interconnected by an electrical connector.

Figure 2:
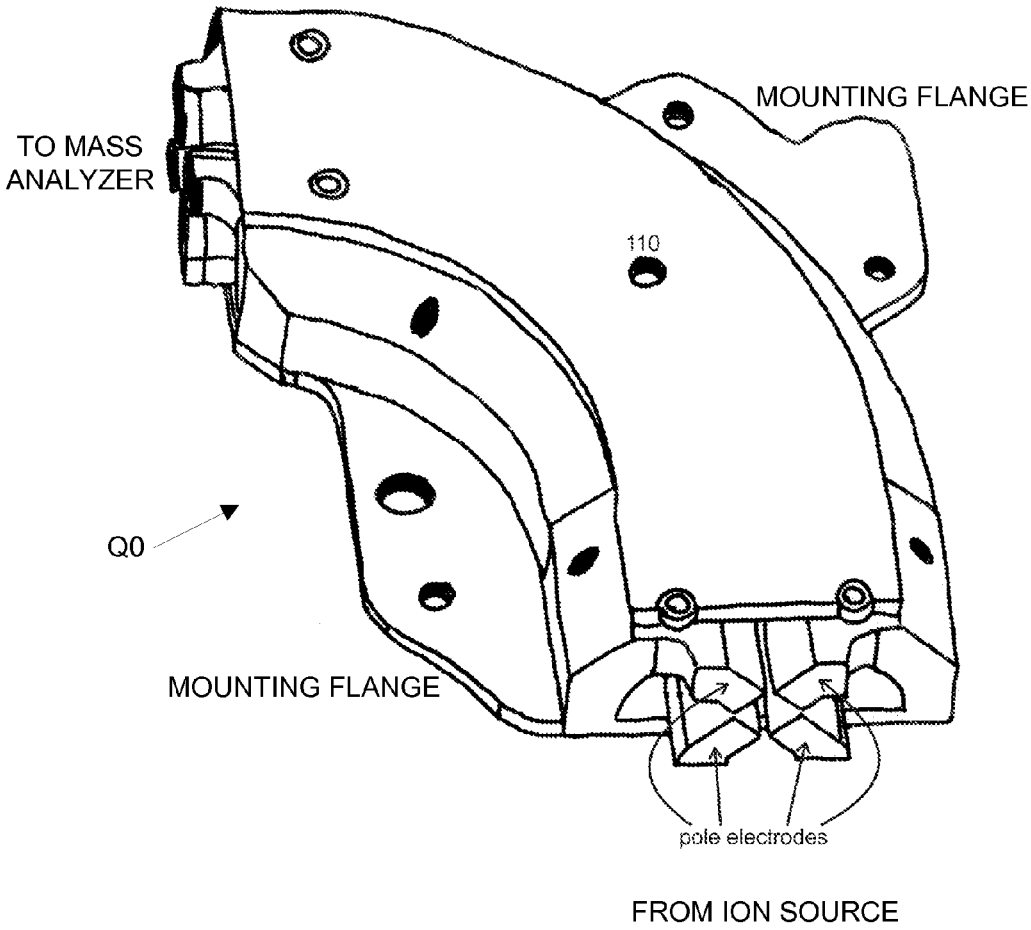
FIG. 2 shows a closed view of the ion guide with a gas inlet located in a center region.

In the embodiment shown in FIGS. 1 and 2 the quadrupole ion guide Q0 is curved by 90°. Radio frequency and direct current (DC) offset voltages can be applied to adjacent pole electrodes. The pole electrode profile at the inner surfaces in this embodiment is generally square as illustrated in the perspective side view of FIG. 2.

Figure 3:
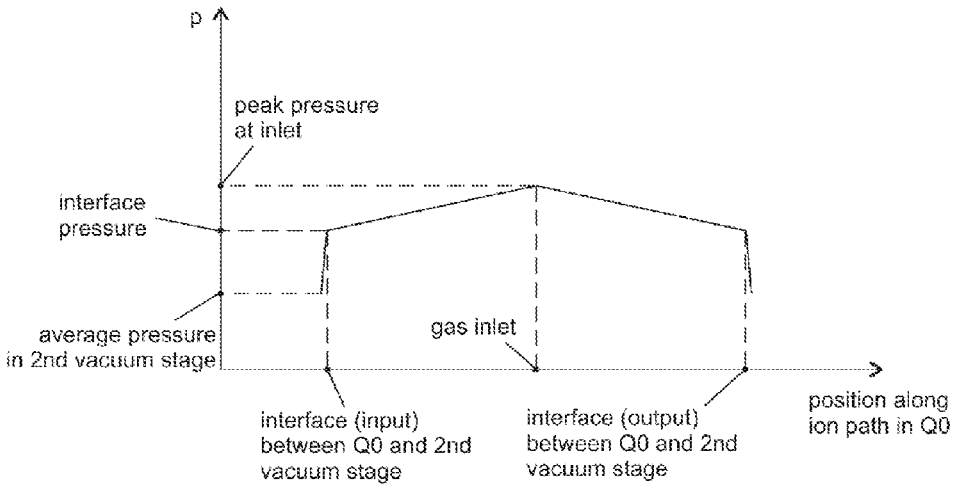
FIG. 3 shows an exemplary pressure profile along the ion path in the ion guide when the inlet is located roughly at the center as shown in FIG. 2.

FIG. 3 shows an exemplary pressure profile along the ion path in the quadrupole ion guide Q0 when an inlet 110 as shown in FIG. 2 is provided in a center region of the ion guide Q0. In this example, the pressure has an approximately trapezoidal profile along the axis of the ion guide. The pressure level peaks at the position of the inlet 110, decreases slightly toward both ends quasi-linearly, and then falls off abruptly to the overall average pressure level in the second vacuum stage 102B. Other pressure profiles than the one displayed are conceivable.

Preferably, the settings of the lens tube 106, such as the pull voltages and/or the geometrical dimension of the lens tube, and the settings of the ion guide Q0, such as DC and/or RF/AC voltages at the pole electrodes, the extension along the ion path, and/or the inner width, are chosen in line with the magnitude of the gas pressure in the ion guide Q0 such that the ions have sufficient axial kinetic energy to reach the position along the ion path in the ion guide Q0 at which the inlet is located before being thermalized by the gentle, non-fragmenting, collisions with the interaction gas. Thereby, gas flowing out from the inlet 110, from this point on the ion path, may act as driving force and accelerate the thermalized ions towards the output end of the ion guide Q0 for promoting further transmission to the subsequent mass analyzer.

Other driving forces, to be used additionally or alternatively, may include for example space-charge push from ions of same polarity, as the case may be, continuously supplied from the ion source 104 and entering the ion guide Q0, or electric field gradients generated within the ion guide Q0, for example, by applying different voltages to different pole electrode segments or stacked ring electrodes arranged serially along the ion path, or as described in aforementioned patent application US 2010/0301227 A1 (corresponding examples not shown in the figures).

Figure 4:
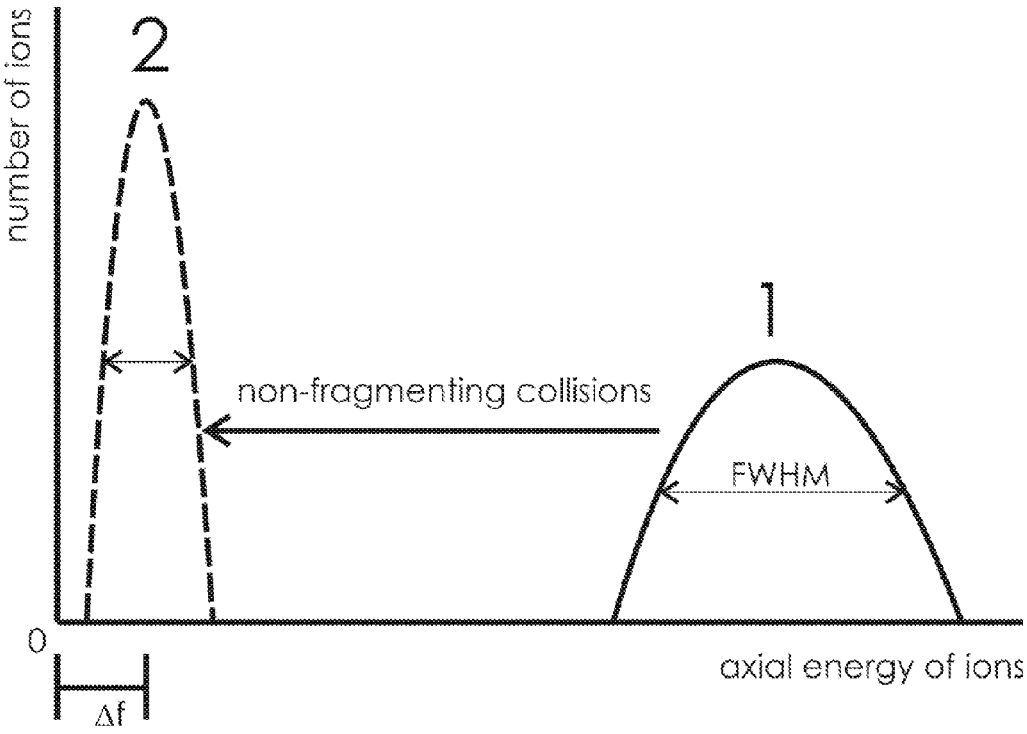
FIG. 4 shows exemplary axial energy distributions of ions before and after traversing the ion guide.

FIG. 4 shows schematically two ion energy distributions in the direction of the ion path before and after traversing the ion guide. Distribution 1, shown on the right, is exemplary of ions being generated in an EI or CI ion source and having been extracted under optimum extraction efficiency conditions as envisioned with the present invention. The position of the distribution on the energy axis essentially derives from the acceleration energy imparted, on average, to the ions in the ion source. The width of the distribution, for example as represented by the full width at half maximum, on the other hand, may depend on the variability of potential gradients, caused by the accelerating voltages, over different sub-volumes in the ion source volume from where the ions are extracted. Other factors such as different initial energy states brought about by the gas flow from the gas chromatograph or during the ionization process can, however, also contribute. The width may amount to between one and five electron Volts. When ions having an energy distribution as shown under number 1 propagate on an ion path, the ion ensemble axially diverges with faster ions taking the lead and slower ions falling behind causing an axial blur of the ions. This is disadvantageous, in particular when a mass spectrometer is operated in a transit mode (that is, when ions are threaded through subsequent components of the mass spectrometer in a continuous motion without interruptions), and time-of-flight arrangements are used for mass separation.

Distribution 2, shown on the left in FIG. 4, is exemplary of ions, which have traversed an ion guide configured and operated in accordance with one embodiment of the invention on their way to a mass analyzer. By supplying the ion guide with an interaction gas for promoting gentle (non-fragmenting) collisions with the ions, and by coordinately choosing settings such as the pressure level of the interaction gas, the extraction voltages at the ion source, the geometrical dimension of the ion exit at the ion source, the length of the ion guide along the ion path, the inner width of the ion guide, the operating voltages applied to the ion guide, or any combination thereof, the axial energy of the ions can be thermalized causing the motion history of the ions in the direction of the ion path to be deleted and reducing further axial diverging. The position of distribution 2, as indicated by the distance Δf from the origin, generally derives from an additional driving force exerted on the thermalized ions and intended for moving them forward up to the output end of the ion guide and on to the mass analyzer. As evident, distribution 2 is narrower than distribution 1, whereas the number of ions occupying certain energy states is increased. In general, the integral over distribution 1 should roughly equal the integral over distribution 2 when no ions are lost during the collisions.

The curved configuration of the exemplary 90° curved quadrupole ion guide Q0 allows a longer interaction cell in a smaller space and results in lower operational pressures and elimination of non-charged particles. The square cross-section permits multipole fields with the corner gaps optimized to accommodate pressure drop. The necessity for a small aperture before and after the quadrupole ion guide is obviated since, in the example shown in FIG. 2, an open gap is used at either end thereof.

The continuous rod design shown in FIGS. 1 and 2 reduces mechanical cost and simplifies the electronic design. However, at least one of the pole electrodes may consist of segments, which are supplied by an incrementally rising or falling potential in order to establish an electric field gradient for driving the ions. The interaction cell Q0 shown is lens-free thus reducing ion node effects. Further, with a longer interaction cell, lower pressure operation is permitted by increasing pumping speed. A 180° implementation of the ion guide, not shown, would have the same effect of permitting neutral particles to be removed from the ion path, because they are not focused by the RF fields and travel essentially in a straight line as indicated in FIG. 1 for the embodiment with the 90° design.

The square quadrupole inner width cross section as shown in FIG. 2 allows a field free region in the center of the dipoles, further reducing ion node effects and bringing about a broad stable mass range for a given RF amplitude. An appropriate gap can be selected between adjacent electrodes to optimize the evacuation sections and still maintain ion stability. Also, by adding a DC voltage to all four electrodes, the ion entrance velocity can be easily adjusted over a wide range of energies.

While the apparatus has been described with reference to a specific embodiment, the description is illustrative of the invention and is not to be considered as limiting the invention. For example, while nickel or gold plated aluminum is a preferred material for the pole electrodes, other materials can be used such as a composite silicon carbide loaded aluminum alloy. While a 90° curved quadrupole ion guide is described, other configurations such as a linear or 180° curved design can be employed. The square cross sectional configuration of the pole electrodes is preferred but other configurations can be employed within the context of the invention.

EXAMPLE MEASUREMENTS

Figure 5:
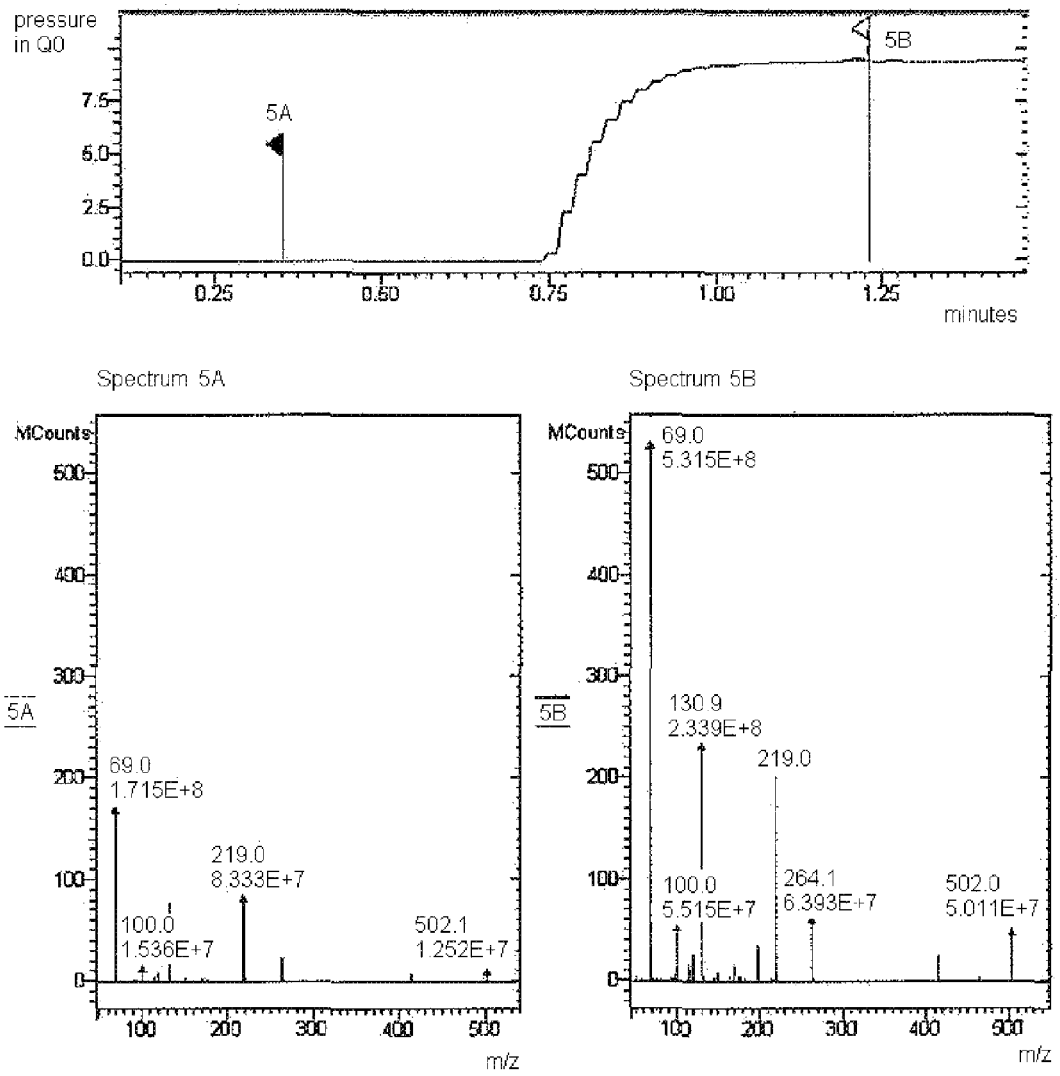
FIG. 5 shows the effect of introducing a collision gas in the ion guide.

The upper panel of FIG. 5 shows a time series of the collision gas pressure (arbitrary units) in the ion guide situated between the ion source and the quadrupole mass analyzer, as shown, for example, in FIG. 1. In this case, however, a 180° curved quadrupole ion guide is used providing an ion path length of about eighteen centimeters. At about 0.75 minutes on the time axis helium as collision gas is introduced in the ion guide Q0. The gradual pressure rise is easily observed. Prior to the introduction of helium, at low pressure, a first mass spectrum of perfluorotributylamine (PFTBA) is taken (see flag 5A in the upper panel). After the final average pressure level (in this particular example, about 1.3 Pascal) is reached, and the voltages supplied to primary mass filter Q1 are adjusted for retaining a comparable peak width (herein always with respect to the full width at half maximum, FWHM), another mass spectrum of the same compound is acquired (see flag 5B in the upper panel). In comparison, the two mass spectra 5A and 5B in the lower part of the figure exhibit the sensitivity for the fragment ions of the compound to be enhanced by more than factor three. One of the least stable fragments, at m/z 219.0, still grows by a factor of circa 2.5.

Small deviations of peak position between individual mass spectrum acquisitions are not relevant to the present experiment as they may be attributed to slightly varying peak shapes affecting the determination of the centroid position, such as, for example, in FIG. 5 the position at 502.1 m/z (acquisition 5A, on the left) and at 502.0 m/z (acquisition 5B, on the right).

Figure 6:
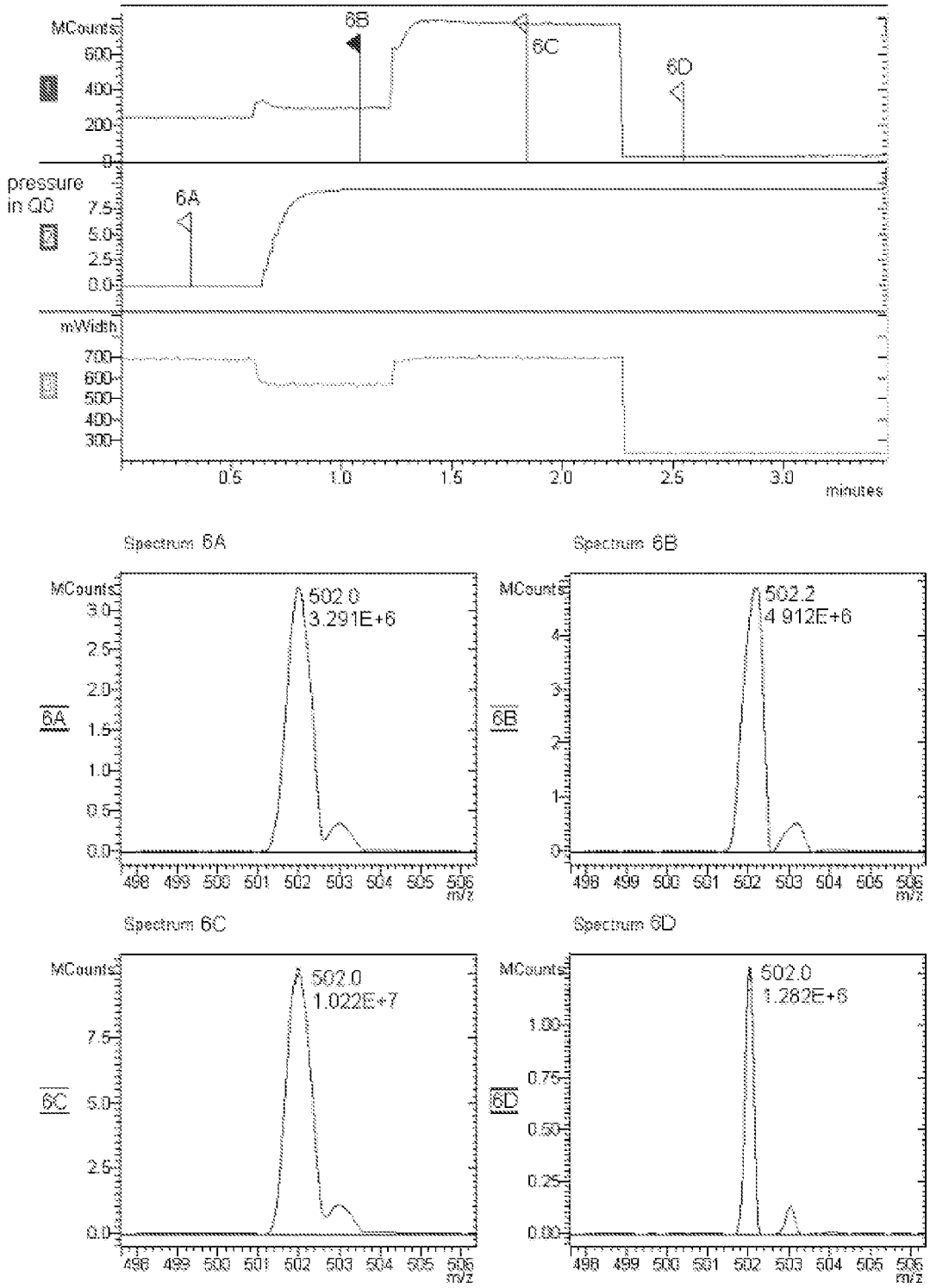
FIG. 6 shows the effect on ion sensitivity and mass resolution of introducing a collision gas in the ion guide.

FIG. 6 is another example of the effect of introducing helium, in this case again at a pressure level of about 1.3 Pascal, in the quadrupole ion guide. Again, the ion guide provides about eighteen centimeters of ion path length. Here, the peak profile at m/z 502.0 is studied in more detail. The upper, middle and lower panels of the upper triple stacked plot (designated as 1, 2, and 3) show the total number of ion counts at the ion detector, interaction gas pressure in the ion guide Q0 and peak width in milli atomic mass units, respectively. As can be seen, helium is introduced at about 0.65 minutes on the time scale.

In total, four measurements 6A to 6D are shown taken at times designated by flags in the upper two panels. The changes in the count profile in the uppermost panel arise from the adjustment procedure when the voltages of the mass filter Q1 are tuned for balancing ion transmission and peak width. With helium present in the ion guide, the total number of ion counts increases but only slightly. This behavior can be explained with the thermalization of the kinetic energy of the ions during the gentle collisions, which causes a significant energy reduction. The thermal energy of the ions may then not suffice any more for overcoming the electric field barrier at the entrance of the first mass filter Q1 when using the voltage settings adjusted in the absence of helium. Consequently, the voltage settings have to be tuned in order to again obtain comparable transmission levels. Four total count steps are visible, in each of which one of the mass spectra 6A to 6D is acquired. Panel 3 of the triple stacked plot, the lowermost, shows the resultant peak width corresponding to the different system settings displayed in the panels on top thereof.

In the lower part of FIG. 6 the four mass spectra corresponding to the acquisitions 6A to 6D are shown. Acquisition 6A features the peak shape when no helium is present. The voltage settings of the first mass filter Q1 are set such that a peak width of about 0.7 atomic mass units results. Acquisition 6B shows how, after introducing helium, the ions lose kinetic energy to the point where it is generally insufficient for overcoming the aforementioned electric field barrier, so that many of them are effectively blocked from passing through. At the same time the ions are focused toward the axis of the ion guide so that they are injected in the first quadrupole mass filter Q1 with maximum efficiency. As a combined effect, the sensitivity is only slightly higher compared to acquisition 6A. Another effect is that the peak shape looks distorted, in this case slightly bent to the right, and thin, with higher resolution of about 0.57 atomic mass units, because only the most energetic ions in the distribution are transmitted through the first mass filter Q1.

In contrast to that, a magnitude increase of about factor three, shown in acquisition 6C, results when introducing helium and adjusting the operating voltages of the first mass filter Q1 for obtaining a similar resolution of about 0.7 atomic mass units resembling the settings in acquisition 6A. Alternatively, when introducing helium and adjusting the operating voltages for obtaining better spectral resolution, ion transmission efficiency degrades (as seen in the reduced number of ion counts in acquisition 6D) while, at the same time, a significantly higher resolution of 0.15 atomic mass units is achieved.

Figure 7:
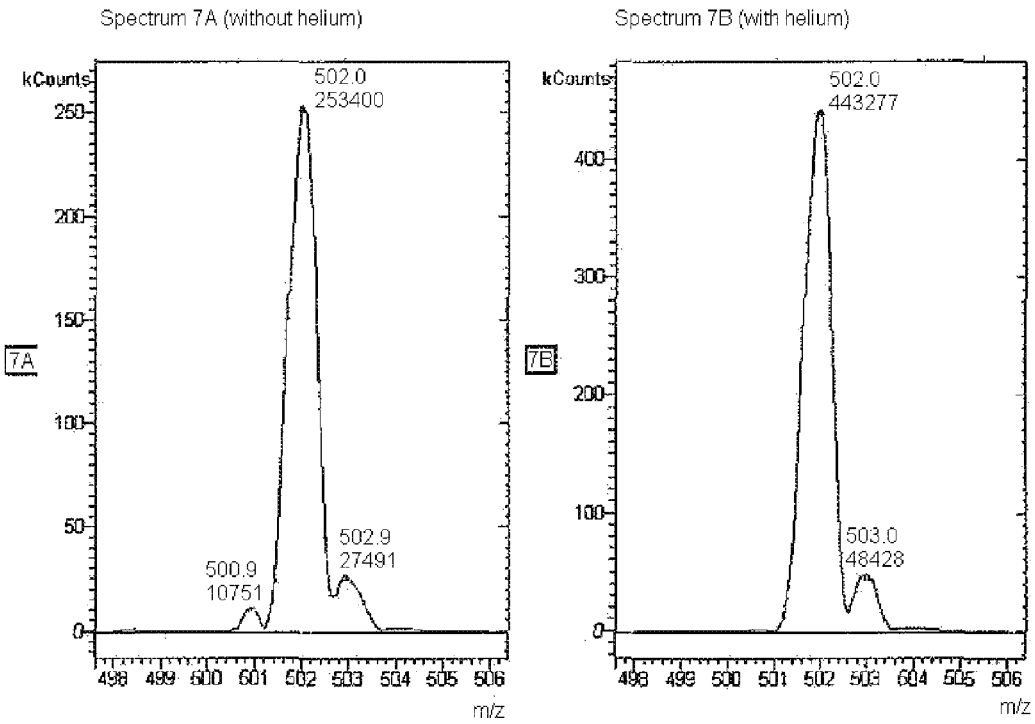
FIG. 7 shows the effect on ghost mass signals of introducing a collision gas in the ion guide.

FIG. 7 shows how the ion guide can be used to enhance the robustness of a quadrupole mass analyzer used in GC-MS. The spectra show the profile peak of the PFTBA fragment at m/z 502.0 and the effect of introducing helium into the ion guide. In acquisition 7A, without any interaction gas, a false mass peak commonly called "precursor" at m/z 500.9 appears, which is an artifact originating most likely from contamination of the analyzer electrodes. Acquisition 7B shows the same mass peak profile when helium is introduced and the voltages of the first mass filter Q1 are adjusted in respect of comparable peak width. The actual peak magnitude increases about a factor of two, and the artifact peak at m/z 500.9 almost completely disappears. This effect may be attributed to ion collisions with neutrals prior to the actual mass analysis. Reducing the energy spread, and in particular the radial extent, of the ion beam transferred to the mass analyzer not only increases the transmission of the mass filter but also keeps the injected ions in the center, farther from potentially contaminated rods, so that any interference originating from the contamination is reduced. Additionally, the introduction of helium also improves the peak shape favorably.

Figure 8:
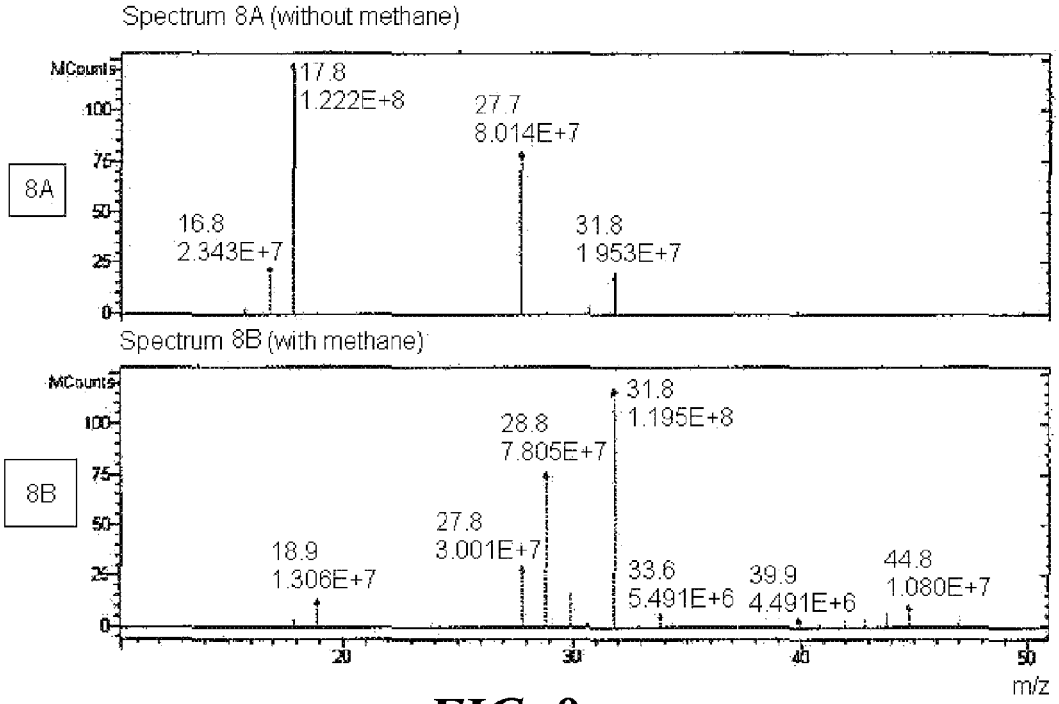
FIG. 8 shows the effect of introducing a chemically reactive gas in the ion guide.

FIG. 8 shows the effect of introducing methane gas as chemical reagent in the ion guide Q0. Comparing the two spectra 8A (without methane) and 8B (with methane), and accounting for the adjustment of the voltages at the mass filter located immediately downstream from the ion guide as before, reveals different spectral peak signatures. In particular, the formation of different ions, methane reagent and others characteristic of positive chemical ionization of background air/water molecules with methane is observed. By means of such a chemical modification prior to mass analysis, identification of unknown ions may be improved. As the case may be, chemical modification might prove useful for identifying and eliminating matrix interferences.

It will be understood that various aspects or details of the invention may be changed without departing from the scope of the invention. Furthermore, the foregoing description is for the purpose of illustration only, and not for the purpose of limiting the invention, which is defined solely by the appended claims.

The invention claimed is:

1. A method of transmitting ions in a mass spectrometer having an ion source with an ion exit and a mass analyzer and maintained in a sub-atmospheric pressure regime, comprising:

(a) generating analyte ions in the ion source, the ion source having an ion source volume comprising a plurality of subvolumes;

(b) applying extraction voltages for extracting analyte ions through the ion exit, wherein the extraction voltages and geometrical dimensions of the ion exit are configured so that analyte ions generated in substantially all of the subvolumes of the ion source volume are extracted and an energy distribution width of the extracted analyte ions is maximized;

(c) transmitting the extracted analyte ions through an ion guide to the mass analyzer, the ion guide being filled with an interaction gas; and (d) configuring at least one of an inner width of the ion guide, operating voltages applied to the ion guide, a length of the ion guide, and a pressure of the interaction gas so that the analyte ion energy distribution width is narrowed and the analyte ions are collimated within the ion guide.

2. The method of claim 1, wherein, in step (b), the extraction voltages and geometrical dimensions are configured so that a number of extracted analyte ions is maximized.

3. The method of claim 1, wherein in, step (b), the extraction voltages and geometrical dimensions are configured and step (d) is performed so that the analyte ion energy distribution width in a direction of ion travel is narrowed.

4. The method of claim 3, wherein step (d) is performed so that the analyte ions are thermalized in the ion guide, and wherein the method further comprises exerting a driving force on the thermalized analyte ions to drive them towards the mass analyzer.

5. The method of claim 4, wherein the driving force is exerted by one of a direct current electric field gradient established along an ion path in the ion guide, Coulomb repulsion from analyte ions subsequently entering the ion guide, and a drag force produced by movement of the interaction gas from a point along the ion path at which the interaction gas is supplied to the ion guide.

6. The method of claim 1, wherein step (b) comprises applying extraction voltages between substantially 0 volts and 500 volts.

7. The method of claim 1, wherein step (d) comprises applying operating voltages to the ion guide with frequencies between about 0.2 and 20 megahertz and amplitudes between substantially 0 volts and 10 kilovolts peak-to-peak.

8. The method of claim 1, wherein, in step (c), the interaction gas is a collision gas with molecules that have non-fragmenting collisions with the analyte ions.

9. The method of claim 8, wherein the interaction gas is helium.

10. The method of claim 1, wherein, in step (c), the interaction gas is a chemically reactive gas that chemically modifies the analyte ions.

11. The method of claim 10, wherein the interaction gas is one of methane and ammonia.

12. The method of claim 1, wherein in step (d), the pressure of the interaction gas in the ion guide reaches a maximum at a position of an inlet through which the interaction gas is supplied to the ion guide, and is reduced at other positions in the ion guide.

13. The method of claim 12, wherein the maximum pressure of the interaction gas is substantially between $10^{-1}$ and 10 Pascal.

14. The method of claim 1, wherein in, step (b), the extraction voltages and geometrical dimensions are configured and step (d) is performed so that less than ten percent of the analyte ions are fragmented in the ion guide.

15. The method of claim 1, wherein step (a) comprises generating the analyte ions from analyte molecules entrained in a gas supplied to the ion source from a gas chromatograph.

16. The method of claim 1, wherein the ion source is maintained in a first pressure area having a pressure between substantially about $10^{-4}$ and 1 Pascal.

17. The method of claim 16, wherein the ion guide and the mass analyzer are located in a second pressure area having a pressure between substantially $10^{-5}$ and $10^{-1}$ Pascal.

18. A mass spectrometer maintained in a sub-atmospheric pressure regime, comprising:

An ion source for generating analyte ions, the ion source having an ion source volume comprising a plurality of subvolumes and an ion exit through which the analyte ions are extracted via extraction voltages, wherein the extraction voltages and geometrical dimensions of the ion exit are configured so that analyte ions generated in substantially all of the subvolumes of the ion source volume are extracted and an energy distribution width of the extracted analyte ions is maximized;

a mass analyzer; and an ion guide that receives the extracted analyte ions and transmits them to the mass analyzer, the ion guide being filled with an interaction gas, wherein at least one of an inner width of the ion guide, operating voltages applied to the ion guide, a length of the ion guide, and a pressure of the interaction gas are configured so that the analyte ion energy distribution width is narrowed and the analyte ions are collimated within the ion guide.

19. The mass spectrometer of claim 18, wherein the extraction voltages and geometrical dimensions of the ion exit are configured so that a number of extracted analyte ions is maximized.

20. The mass spectrometer of claim 18, wherein the extraction voltages and geometrical dimensions of the ion exit and at least one of the inner width of the ion guide, the operating voltages applied to the ion guide, the length of the ion guide, and the pressure of the interaction gas are configured such that the analyte ion energy distribution width is narrowed in a direction of ion travel.

21. The mass spectrometer of claim 18, wherein the ion guide is a multipole ion guide.

22. The mass spectrometer of claim 18, wherein the ion guide is curved along a direction of ion travel.

23. The mass spectrometer of claim 22, wherein the ion guide is curved with an angle of curvature between substantially 30° and 180°.

24. The mass spectrometer of claim 18, wherein the ion guide is constructed as a tube.

25. The mass spectrometer of claim 18, wherein the mass analyzer comprises a primary mass filter, a fragmentation cell for collision induced dissociation, and a secondary mass filter.

26. The mass spectrometer of claim 18, wherein the portion of the ion guide through which the extracted analyte ions pass has a square cross section.

27. The mass spectrometer of claim 26, wherein the mass analyzer has an inlet with an inlet area, the ion guide has an exit area from which the extracted analyte ions exit the ion guide and wherein the exit area is smaller than the inlet area.

28. The mass spectrometer of claim 18, wherein the ion guide has an entrance, an exit and an interaction gas inlet centered between the ion guide entrance and the ion guide exit.

29. The mass spectrometer of claim 18, wherein the extracted analyte ions travel through the ion guide along a path having a length of substantially between 5 and 35 centimeters.

30. The mass spectrometer of claim 18, wherein the ion exit has a cross sectional area, through which the analyte ions are extracted, of between 0.25 and 400 $mm^2$.

31. The mass spectrometer of claim 18 wherein the ion exit comprises a tube lens with a tube to which pull voltages are supplied.

32. The mass spectrometer of claim 31, wherein the geometrical dimensions of the ion exit include an inner radius and rim contour of the tube.

* * * * *